US005800840A

United States Patent [19]

Geus et al.

[11] Patent Number: 5,800,840

[45] Date of Patent: *Sep. 1, 1998

[54] APPARATUS FOR PRODUCING A SPUN-BOND WEB FROM THERMOSPLASTIC ENDLESS FILAMENTS

[75] Inventors: Hans Georg Geus, Niederkassel; Detlef Frey, Troisdorf, both of Germany

[73] Assignee: Reifenhauser GmbH & Co. Maschinenfabrik, Troisdorf, Germany

[ * ] Notice: The term of this patent shall not extend beyond the expiration date of Pat. No. 5,766,646.

[21] Appl. No.: 597,016

[22] Filed: Feb. 5, 1996

[30] Foreign Application Priority Data

Feb. 15, 1995 [DE] Germany ..... 195 04 953.5

[51] Int. Cl.[6] ..... B29C 47/34

[52] U.S. Cl. ..... 425/7; 425/72.2; 264/168; 264/DIG. 75

[58] Field of Search ..... 264/168, DIG. 75; 425/7, 72.2

[56] References Cited

U.S. PATENT DOCUMENTS

| | | | |
|---|---|---|---|
| 2,437,263 | 3/1948 | Manning | 264/115 |
| 3,436,792 | 4/1969 | Hench | 425/7 |
| 3,929,542 | 12/1975 | Gehrig et al. | 264/168 |
| 4,812,112 | 3/1989 | Balk | 425/72.2 |
| 4,813,864 | 3/1989 | Balk | 425/72.2 |
| 4,820,142 | 4/1989 | Balk | 425/72.2 |
| 4,961,695 | 10/1990 | Hirschmann et al. | 425/72.2 |
| 5,034,182 | 7/1991 | Sze et al. | 425/72.2 |
| 5,173,310 | 12/1992 | Katou | 425/72.2 |

FOREIGN PATENT DOCUMENTS

| | | | |
|---|---|---|---|
| 611858 | 4/1935 | Germany | 425/72.2 |
| 05 17 60 483 | 4/1971 | Germany . | |
| 37 13 862 | 11/1988 | Germany . | |
| 4014413A1 | 11/1991 | Germany | 425/72.2 |
| 4014989A1 | 11/1991 | Germany | 425/72.2 |

*Primary Examiner*—Jay H. Woo
*Assistant Examiner*—Minh-Chau T. Pham
*Attorney, Agent, or Firm*—Herbert Dubno; Andrew Wilford

[57] ABSTRACT

An apparatus for producing spun-bond fleece has the process shaft connected to a source of process air and opening into a depositions shaft centrally thereof and flanked by streams of air bypassing the process shaft. The result is a random jumbling of the fibers as they deposit on the moving belt such that a uniform filament density and homogeneous mesh width are obtained without singularities and without conglomeration of the filaments in the shafts.

4 Claims, 2 Drawing Sheets

APPARATUS FOR PRODUCING A SPUN-BOND WEB FROM THERMOSPLASTIC ENDLESS FILAMENTS

FIELD OF THE INVENTION

Our present invention relates to an apparatus for producing a spun-bond web or mat from thermoplastic endless filaments or threads as they emerge continuously from a spinneret, are passed through a process shaft and are collected on a receiving belt. More particularly, the invention relates to improvements in the imparting of random movements to the filaments as they pass through a deposition unit to form the mat upon the perforated belt and hence the manner in which the web is formed.

BACKGROUND OF THE INVENTION

In the production of so-called spun bond, i.e. a nonwoven fleece or mat with thermoplastic filaments or threads, the endless filaments from a spinneret fed with a molten thermoplastic pass downwardly in a curtain through a process shaft in which those filaments are cooled and stretched, generally by entrainment in a flow of process air.

Thermoplastic endless filaments are to be distinguished from substantially shorter filaments, frequently referred to as staple fibers, which may be torn away from the strands emerging from the spinneret orifices by jets of process air in, for example, the melt blown process.

In the downward movement of the filaments toward the collecting belt, which is generally perforated to allow evacuation below the belt of the process air with which the filaments are entrained downwardly, the filaments receive a transverse movement which is superimposed upon the downward movement and imparts a stochastic or random distribution to the filaments which causes loops of the filaments to form randomly over and under one another. This movement has a greater or lesser frequency and a greater or lesser amplitude in its random distributions and affects significantly the so-called mesh width and the filament density of the web.

It is desirable to have a substantially homogeneous mesh width without singularities and, of equal importance, to have a constant filament density across the width of the web as it is produced.

As has been noted, the filaments which are deposited to form the web are stretched by entrainment with the process air and by gravitational action in the shafts described and a uniform stretching is important in obtaining a product with uniform quality.

In the terminology of spun-bond technology, the process shaft is frequently also referred to as a cooling shaft and the shaft below the cooling shaft in which some stretching takes place and in which transverse movement is superimposed upon the downward movement of the curtain of filaments, is frequently referred to as a stretching shaft. The process air is usually circulated in a closed system via a heat exchanger which extracts heat picked up by the process air from the filaments. The process air can be drawn away below the collecting belt by, for example, a suction blower and the perforated belt can be formed as a sieve belt.

In an apparatus of this type (see German patent document 37 13 862 and U.S. Pat. No. 4,820,142), the deposition unit is a deposition shaft which extends transversely to the receiving belt and has a cross section transverse to this belt which is in the form of a venturi nozzle or a diffuser, the shaft having a constriction with an upstream portion converging toward the constriction and a downstream portion diverging therefrom, while the diffuser simply widens toward the belt. In order to influence the stochastic movements and particularly the frequency and amplitudes thereof, thereby optimizing the mesh width and the filament density, mechanical devices are provided, for example, in the form of adjustable flaps in the deposition shaft and in its cross section. In this approach there are frequently problems in reproducibility and a dependency of the results on the output of the apparatus.

OBJECTS OF THE INVENTION

It is therefore the principal object of the present invention to provide an apparatus for the production of spun bond from thermoplastic endless filaments which yields a spun-bond web or fleece with a practically homogeneous mesh width and an endless filament density which is constant within a narrow range.

Another object of the invention is to provide an improved apparatus for the fabrication of spun bond which eliminates drawbacks with prior-art devices.

It is also an object of this invention to provide an apparatus capable of yielding high-quality spun-bond fleece which is uniform in its properties and is not affected by operation at high outputs so as to yield especially reproducible results.

SUMMARY OF THE INVENTION

These objects and others which will become apparent hereinafter are attained, in accordance with the invention, by providing the deposition unit so that it has a central inlet passage for the endless filament curtain which extends transversely to the receiving belt and by providing on both sides parallel to the inlet passage flow passages for the fleece forming air streams, a deposition shaft being connected to the inlet passage which ends just above the receiving belt.

The mouth of the deposition shaft can be of an adjustable height so that the deposition shaft can end at different levels above the belt.

In a preferred embodiment of the invention, the deposition shaft has, at least in its lower region, a diffuser configuration transverse to the direction of displacement of the deposition belt. The diffuser configuration may have opposite sides flaring away from one another. The diffuser angle is so set that an especially intensive homogenization effect can be achieved.

The central inlet passage can be connected to the process shaft. A possible construction in accordance with the invention connects the central inlet passage centrally to the process shaft and provides bypass passages which are connected to the process shaft and form the outlet for the streams of air parallel to the curtain of filaments. According to the invention supply passages for the fleece-forming air streams also can be provided transverse to the inlet passage and its side faces.

In general, the device is so constructed and adjusted that the volume rate of flow of the process air which traverses the inlet passage and the volume rate of flow of the fleece-forming air streams are adjustable and/or regulatable, preferably independently of one another.

The aerodynamic effect on the endless filament density and the mesh width of the spun-bond web during the fleece-forming operation, which has been achieved with flaps heretofore, can be accomplished in accordance with the invention, surprisingly, with great long-term operational stability and reproducibility, utilizing the air streams which flow parallel to the curtain at the inlet of the deposition shaft symmetrically on both sides of the centrally disposed filament curtain. It is especially of significance and most surprising that the endless threads in the filament curtain remain individual and separate from one another without the formation of conglomerates so that singularities in the spun-bond webs resulting from conglomerates, will be avoided. Of course, where the loops of the filaments lie upon one another and the strands cross one another, the filaments tend to bond together to stabilize the web.

More particularly, the apparatus for producing a spun-bond web can comprise:

a spinneret having a multiplicity of orifices for molten thermoplastic from which respective endless thermoplastic filaments pass downwardly in a curtain of the filaments;

a process shaft below the spinneret receiving the curtain of filaments and means for supplying the process shaft with process air for cooling the curtain of filaments as the curtain of filaments passes through the process shaft;

a collecting conveyor belt below the process shaft for receiving the filaments of the curtain and accumulating the filaments to form a spun-bond mat of the continuous filaments; and a filament-depositing unit between the process shaft and the collecting conveyor belt for applying a stretching action to the filaments of the curtain and superimposing on the stretching action a fleece-forming movement of the filaments whereby the filaments collect stochastically on the belt, the filament-depositing unit comprising:

means forming a central inlet passage extending transversely of the collecting conveyor belt and opening into the filament-depositing unit at an upper end thereof for centrally admitting the curtain of filaments to the filament-depositing unit, means forming air-feed passages on opposite sides of the central inlet passage and parallel thereto for directing air streams along the filaments of the curtain, thereby applying the stretching action to the filaments of the curtain, and a filament-depositing shaft enclosing the passages and extending downwardly to a location above the belt and within which a fleece-forming movement of the filaments is superimposed on the stretching action whereby the filaments collect stochastically on the belt.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
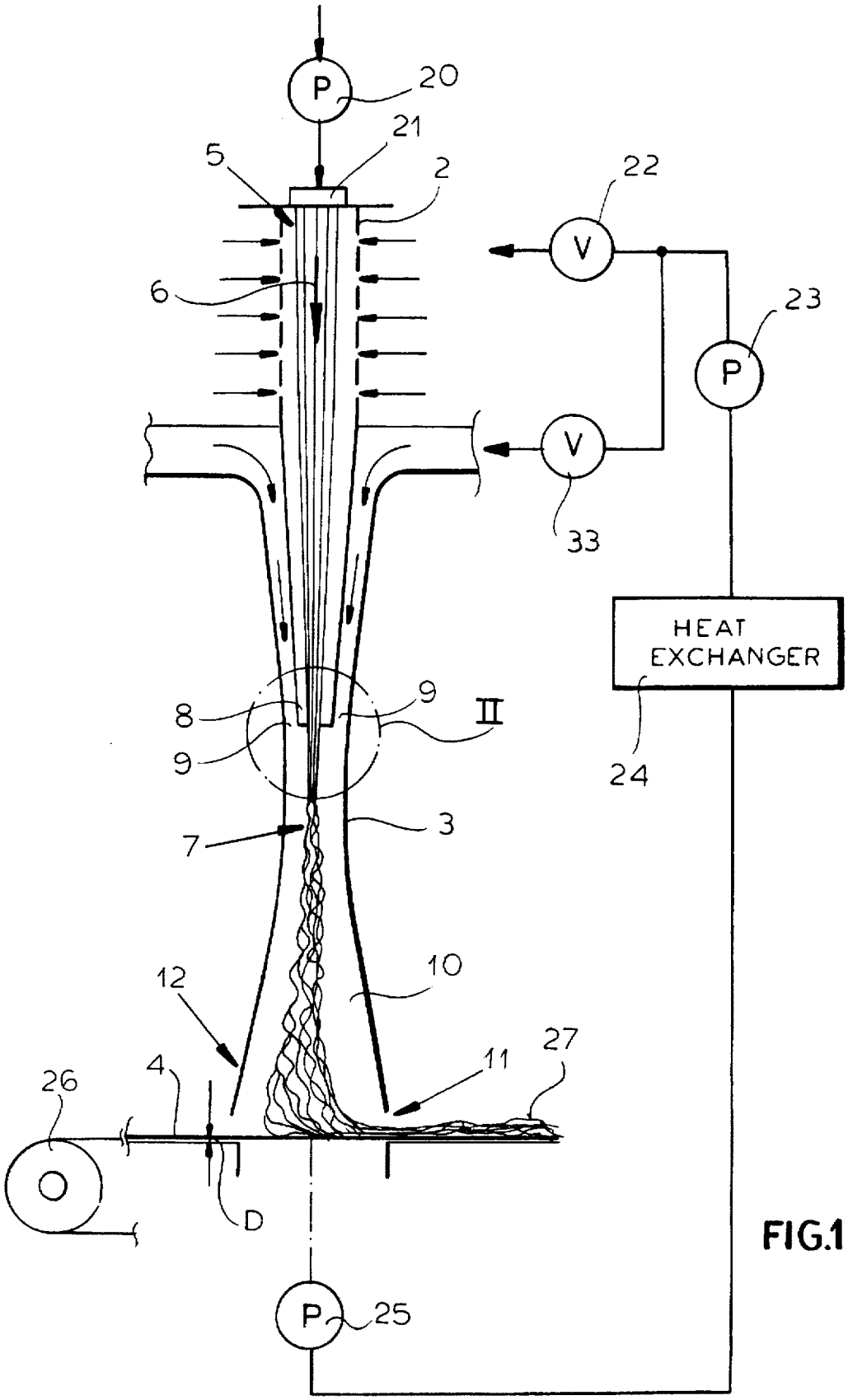
FIG. 1 is a diagrammatic vertical section through a spun-bond apparatus according to the invention.

The apparatus shown in the drawing is used for the production of a web of spun bond from thermoplastic synthetic filaments which are endlessly produced by a spinneret 21 having a source of molten thermoplastic represented by the pump 20.

The apparatus comprises, below the spinneret 21 from which the descending curtain 5 of the monofilament emerges, process shaft 2 which subjects the descending filaments of the curtain 5 (arrow 6) to a process air flow for cooling. While each strand of thermoplastic of the filament curtain 5 is molten as it emerges from the spinneret, it begins to solidify in the process shaft 2. The cooling process air is supplied through a valve 22 by a blower 23 at least in part from a heat exchanger 24 used to cool the process air which can be recirculated from the shaft by a blower 25.

Below the process shaft 2 is a deposition unit represented generally at 3 and, below the latter, there is a collecting conveyer belt 4 in the form of a sieve belt, through the perforations of which the process air is drawn by the suction side of the pump 25. Only one of the rollers 26 of the conveyor belt has been shown in FIG. 1. The fleece or web of the spun bond is represented at 27 and will be understood to consist of random overlay and interlays of loops of the endless threads of the curtain 5; which bond together at their contact points. The web 27 may be consolidated by passing it between a pair of calendaring rolls.

The arrow 6 also represents the drawing action upon the curtain 5. This drawing action can be generated in part by the increased velocity of the process air flow from the outlet of the process shaft which, at 8, corresponds to the inlet to the deposition shaft 3.

Figure 2:
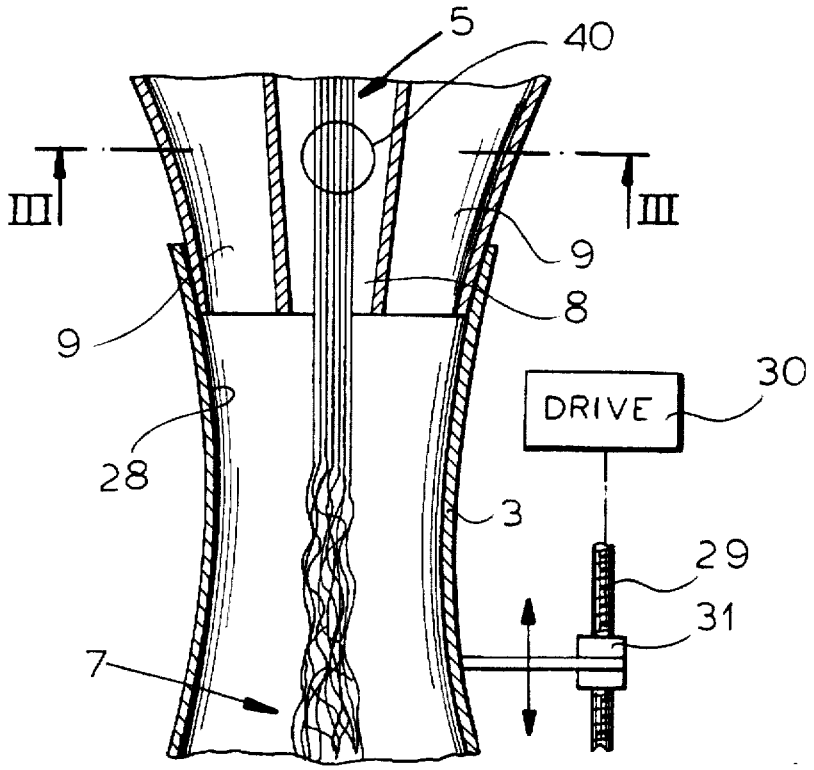
FIG. 2 is a detail of the region II of FIG. 1.

In the deposition unit or shaft, a fleece-generating movement is superimposed on the drawing action represented by the arrow 6 and the fleece-forming movement can be considered to be a transverse jumbling of the filaments as seen at the lower part of FIG. 2, in which the filaments are randomly displaced transversely with a variable frequency and amplitude.

A comparison of FIGS. 1 and 2 will show that the deposition unit 3 has a central inlet passage 8 for the filament curtain 5 which extends transversely to the collection belt 4. On both sides and parallel to the inlet passage 8 are feed passages 9 for the fleece-forming air streams which symmetrically are directed along the curtain 5 as it passes through a constricted portion 28 (FIG. 2) of the shaft 3. Downstream of the constricted portion 28, the shaft 3 widens in a diffuser 12 which terminates just above the web 27 at a mouth 11. The lower portion of the shaft is represented at 10.

The diffuser 12 can be formed only at the lower end as well if desired. The height of the mouth 11 can be adjusted, e.g. by a spindle 29 driven by a drive 30 and engaging a nut 31 coupled to the deposition unit 3 (FIG. 2).

As can be seen from FIG. 1, moreover, the blower 23 supplies not only the valve 22 but also a valve 33 which determines the proportion of the process air directly contacting the curtain 21 in the process shaft 2 and that portion which is bypassed to the flat nozzles 9 from which the streams of air flank the curtain and induce the oscillation in the filaments. The volume rate of flow of the process air which passes through the passage 8 and the volume rates of flow of the streams from the nozzles 9 can be controllable or regulatable, preferably independently from one another.

Figure 3:
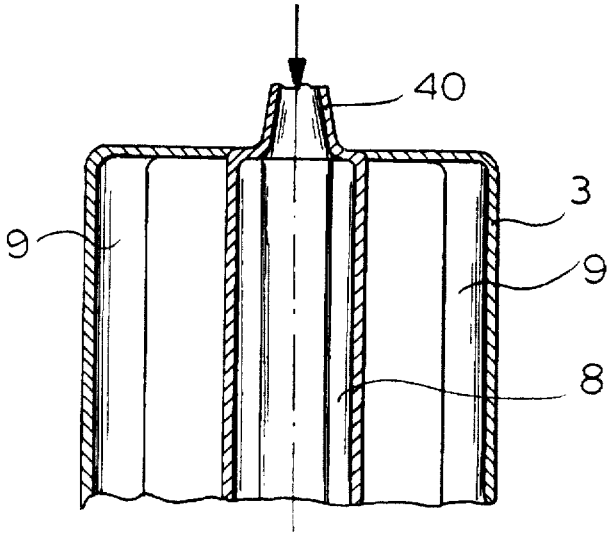
FIG. 3 is a section along line III—III of FIG. 2.

Additionally passages for the fleece-forming air stream can be provided transverse to the inlet passage 8 on its end faces as shown at 40 in FIG. 3. With the invention, surprisingly, a spun-bond fleece is obtained which has a filament density which is constant within narrow tolerances over the entire surface of the web and a substantially homogeneous mesh width, free from singularities. Control of the rate of flow of the process air entering the deposition unit 3 at the inlet passage 8 allows adjustment of the degree of stretching of the filaments.

It is also possible to distribute over the length of the deposition shaft 10 or at just one or several locations therealong, passages for evacuating process air which can be connected to a suction pump.

We claim:

1. An apparatus for producing a spun-bond web of endless thermoplastic filaments, comprising:

a spinneret having a multiplicity of orifices for molten thermoplastic from which respective endless thermoplastic filaments pass downwardly in a curtain of said filaments;

a process shaft below said spinneret receiving said curtain of filaments and means for supplying said process shaft with process air for cooling said curtain of filaments as said curtain of filaments passes through said process shaft;

a collecting conveyor belt below said process shaft for receiving said filaments of said curtain and accumulating said filaments to form a spun-bond mat of the continuous filaments;

a filament-depositing unit between said process shaft and said collecting conveyor belt for applying a stretching action to said filaments of said curtain and superimposing on said stretching action a fleece-forming movement of said filaments whereby said filaments deposit in random loops on said belt, said filament-depositing unit comprising:

means forming a central inlet passage extending transversely of said collecting conveyor belt and opening centrally with respect to said process shaft into said filament-depositing unit at an upper end thereof for centrally admitting said curtain of filaments to said filament-depositing unit together with said processing air, means forming air-feed passages on opposite sides of said central inlet passage parallel to said central inlet passage and opening into the filament-depositing unit in the same direction as said central inlet passage for directing air streams along said filaments of said curtain, thereby applying said stretching action to said filaments of said curtain, said air-feed passages extending as bypasses from said process shaft along said central inlet passage to a lower end of said central inlet passage, and a flap-free filament-depositing shaft having a downwardly converging upper end enclosing said passages and extending downwardly to a constriction and a downwardly diverging lower end extending downwardly from said constriction to a location above said belt and within which a random fleece-forming movement of said filaments, produced exclusively by aerodynamic action, is super-imposed on said stretching action whereby said filaments collect randomly on said belt; and first control means for regulating a volume rate of flow of the process air through said process shaft and out of said central inlet passage, and second control means for regulating a volume rate of flow of air through said air-feed passages, said first and second control means being constructed so that said volume rates of flow are controllable independently from one another.

2. The apparatus defined in claim 1 wherein said filament-depositing shaft has an outlet at said lower end extending transversely to a direction of displacement of said belt and widening downwardly with a diffusor cross section.

3. The apparatus defined in claim 1 wherein said means forming said central inlet passage is provided on said process shaft.

4. The apparatus defined in claim 1 wherein said means forming said air-feed passages is provided on faces of said central inlet passage transversely thereto.

* * * * *